US010918247B1

(12) United States Patent
Hollis

(10) Patent No.: US 10,918,247 B1
(45) Date of Patent: Feb. 16, 2021

(54) TOILET LIFT SEAT

(71) Applicant: Steve Hollis, Herman, NE (US)

(72) Inventor: Steve Hollis, Herman, NE (US)

( * ) Notice: Subject to any disclaimer, the term of this patent is extended or adjusted under 35 U.S.C. 154(b) by 21 days.

(21) Appl. No.: 16/587,681

(22) Filed: Sep. 30, 2019

Related U.S. Application Data

(60) Provisional application No. 62/745,040, filed on Oct. 12, 2018, provisional application No. 62/739,608, filed on Oct. 1, 2018.

(51) Int. Cl.
*A47K 13/10* (2006.01)

(52) U.S. Cl.
CPC ..... *A47K 13/10* (2013.01)

(58) Field of Classification Search
USPC ..... 4/667
See application file for complete search history.

(56) References Cited

U.S. PATENT DOCUMENTS

| | | | | |
|---|---|---|---|---|
| 3,925,833 | A | 12/1975 | Hunter | |
| 5,309,583 | A | 5/1994 | White et al. | |
| 5,819,325 | A | 10/1998 | Richards | |
| 2002/0124308 | A1 | 9/2002 | Ward | |
| 2013/0232686 | A1* | 9/2013 | Schwartz | A61G 7/1007 4/667 |

* cited by examiner

*Primary Examiner* — Christine J Skubinna
(74) *Attorney, Agent, or Firm* — Erickson Kernell IP, LLC; Kent R. Erickson

(57) ABSTRACT

A toilet lift seat positionable over a toilet bowl is liftable by actuators connected to the lift seat such that the lift seat initially pivots forward as the actuators lift the lift seat off of the bowl. An underside of the lift seat is pivotally connected to upper ends of the actuators such that a center of gravity of the lift seat extends forward of a pivot axis of the lift seat. Stops connected to the actuators are separated from a front portion of the lift seat when it is supported in a lowered position above the toilet bowl. When the actuators are engaged to lift the lift seat, the lift seat pivots forward until its underside engages the stops preventing further forward pivoting of the lift seat relative to the actuators as the actuators continue to lift the lift seat. The actuators may be water driven.

10 Claims, 7 Drawing Sheets

TOILET LIFT SEAT

CROSS-REFERENCE TO RELATED APPLICATIONS

This application claims the benefit of U.S. Provisional Patent Application Nos. 62/745,040, filed Oct. 12, 2018 and 62/739,608, filed Oct. 1, 2018, the disclosures of which are hereby incorporated herein in their entirety by reference

BACKGROUND OF THE INVENTION

Field of the Invention

This invention relates to seats for toilets that lift the user to a standing position after use.

Description of the Related Art

Powered seats for assisting individuals of limited mobility and balance in lowering themselves onto and standing up from a toilet are known. Some involve pivoting the seat in an arcuate motion upwards and away from the toilet to assist the user in standing up from the toilet. The arcuate motion imparted by these systems does not correspond to a natural standing motion and can increase the risk of the user falling. U.S. Pat. No. 3,925,833 shows a lifting system that raises the toilet seat vertically, but the patient then has to push themselves off of or scoot off of the horizontally extending toilet seat. There remains a need for an improved toilet lift seat that results in a more natural motion of the user, particularly when lifting themselves off of the toilet. It would also be desirable to provide such a lift that can be readily used with an existing toilet without the need to plug the lift into an electrical power source.

SUMMARY OF THE INVENTION

An improved toilet lift seat assembly is disclosed for use with a toilet having a toilet bowl with a toilet bowl rim from which the conventional toilet seat has been removed. The toilet lift seat assembly includes a toilet seat having a conventional, ovate toilet seat opening extending therethrough. The toilet seat is connected to left and right linear actuators supported in left and right actuator supports or pedestals forming part of a base of the toilet lift seat assembly. The left and right linear actuators are supported by the left and right actuator supports so that the actuators are oriented vertically and extend in spaced relation on opposite sides of the toilet bowl of the toilet with which the toilet lift seat assembly is used.

The toilet seat is supported on the upper ends of the left and right linear actuators through left and right pivot mounts or lift blocks to which the lift seat is pivotally connected. Left and right stop features are associated with and extend forward of the left and right pivot mounts respectively. An underside of the toilet seat is pivotally connected on opposite sides of the toilet seat opening to the left and right pivot mounts such that a center of gravity of the toilet seat extends forward of a pivot axis of the toilet seat relative to the left and right pivot mounts.

A front portion of the toilet seat, extending forward of the pivot axis, is supported on the toilet bowl rim when the left and right linear actuators are retracted to a retracted position whereby the toilet seat is drawn down to a lowered position relative to the toilet bowl and a gap extends between the stop features on the left and right pivot mounts and left and right abutment features respectively on the underside of the toilet seat. Upon vertical extension of the left and right linear actuators from the retracted position, the front portion of the toilet seat pivots downward relative to the left and right pivot mounts supported on the upper ends of the left and right linear actuators and remains supported on the toilet bowl rim until the left and right abutment features on the underside of the toilet seat abut against the left and right stops respectively preventing further forward pivoting of the toilet seat relative to the left and right linear actuators. Further vertical extension of the left and right linear actuators lifts the toilet seat, including the downwardly pivoted front portion of the toilet seat, vertically relative to the toilet bowl rim. The lift seat may be lifted to a height that it is high enough for a user to readily step away from the toilet lift seat. An upper surface of each of the left and right stops is vertically adjustable relative to the left and right pivot mounts respectively to adjust the degree of pivoting of the lift seat relative to the pivot mounts and left and right actuators respectively.

DETAILED DESCRIPTION OF THE PREFERRED EMBODIMENTS

Figure 1:
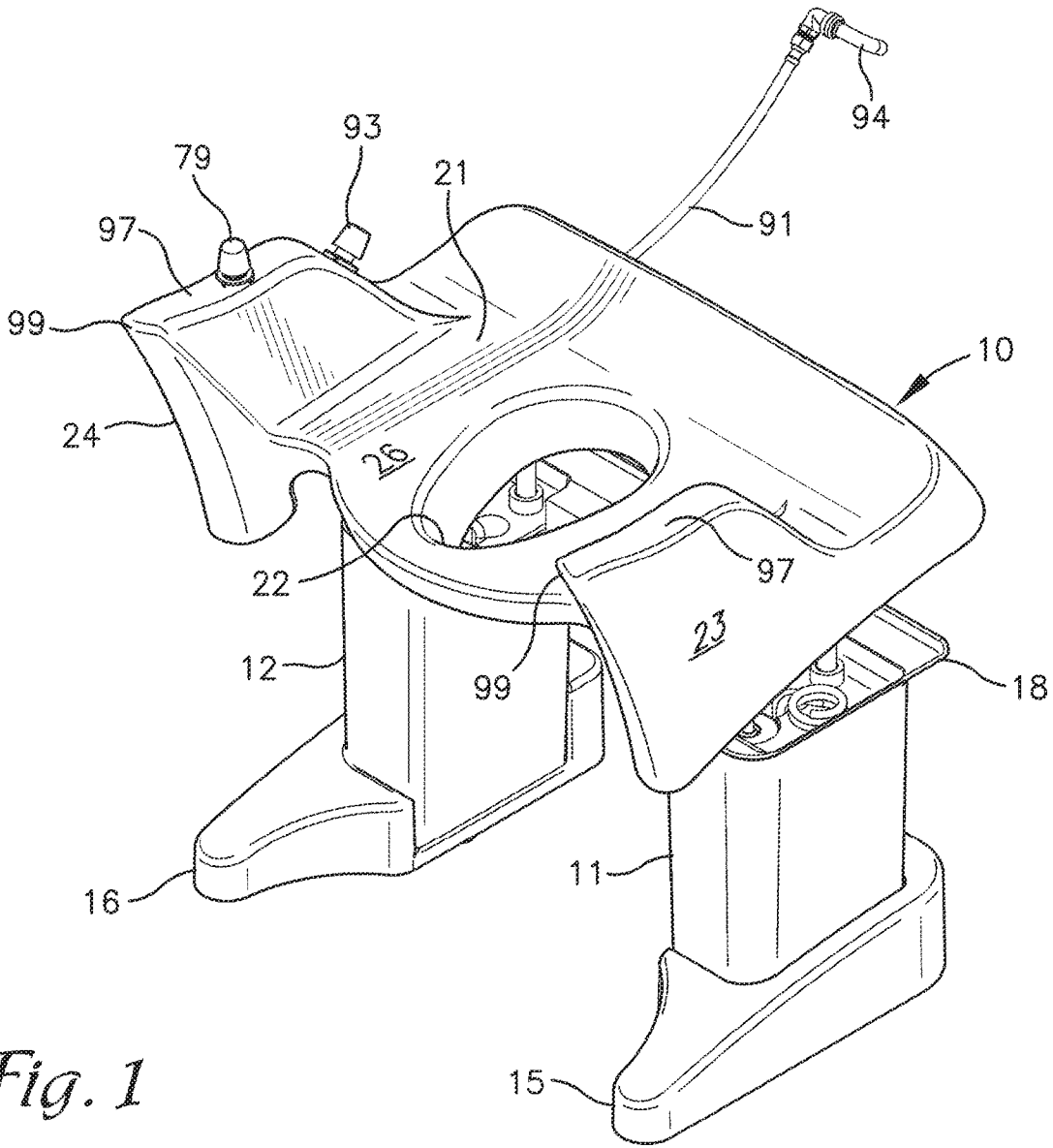
FIG. 1 is a perspective view of a toilet lift seat assembly with a lift seat in a raised position relative to two pedestals housing a hydraulic lift assembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof.

Said terminology will include the words specifically mentioned, derivatives thereof and words of a similar import.

Referring to the drawings the reference number 1 refers to a toilet lift seat assembly which is configured to be positioned over the bowl 3 of an existing toilet 5 (see FIG. 4) from which the existing pivoting toilet seat (not shown) has been removed from above a rim 7 of the toilet bowl 3. As used herein directional references, including left and right are with respect to the side of a user's body when they are sitting on the toilet lift seat assembly 1 over a toilet bowl 3. The lift seat assembly includes a lift seat 10 movably connected to and supported above left and right pedestals 11 and 12 by a hydraulic lift assembly 14. The left and right pedestals 11 and 12 are supported on left and right feet 15 and 16 and are spaced apart a distance to straddle a conventional sized toilet bowl 3. A lateral stabilizing bracket 18 is connected to and extends between upper ends of the left and right pedestals 11 and 12 to provide lateral support.

The lift seat 10 of the embodiment shown is preferably formed from a moldable material including for example fiberglass and is formed as a platform 21 with a central, ovate hole 22 extending through the platform 21 for access to the toilet bowl 3 over which the seat is positioned and left and right arm rests or supports 23 and 24 integrally formed with and projecting upward from the platform 21 in outwardly spaced relation from the ovate hole 22 to form a seating area 26 therebetween. A shroud 28 is integrally formed as part of the lift seat 10 and extends below and around the periphery of the platform 21. A front edge 29 of the platform 21 between the arm supports 23 and 24 is curved rearward and the portion of the shroud 28 depending from the front edge 29 of platform 21 is of reduced length.

Figure 3:
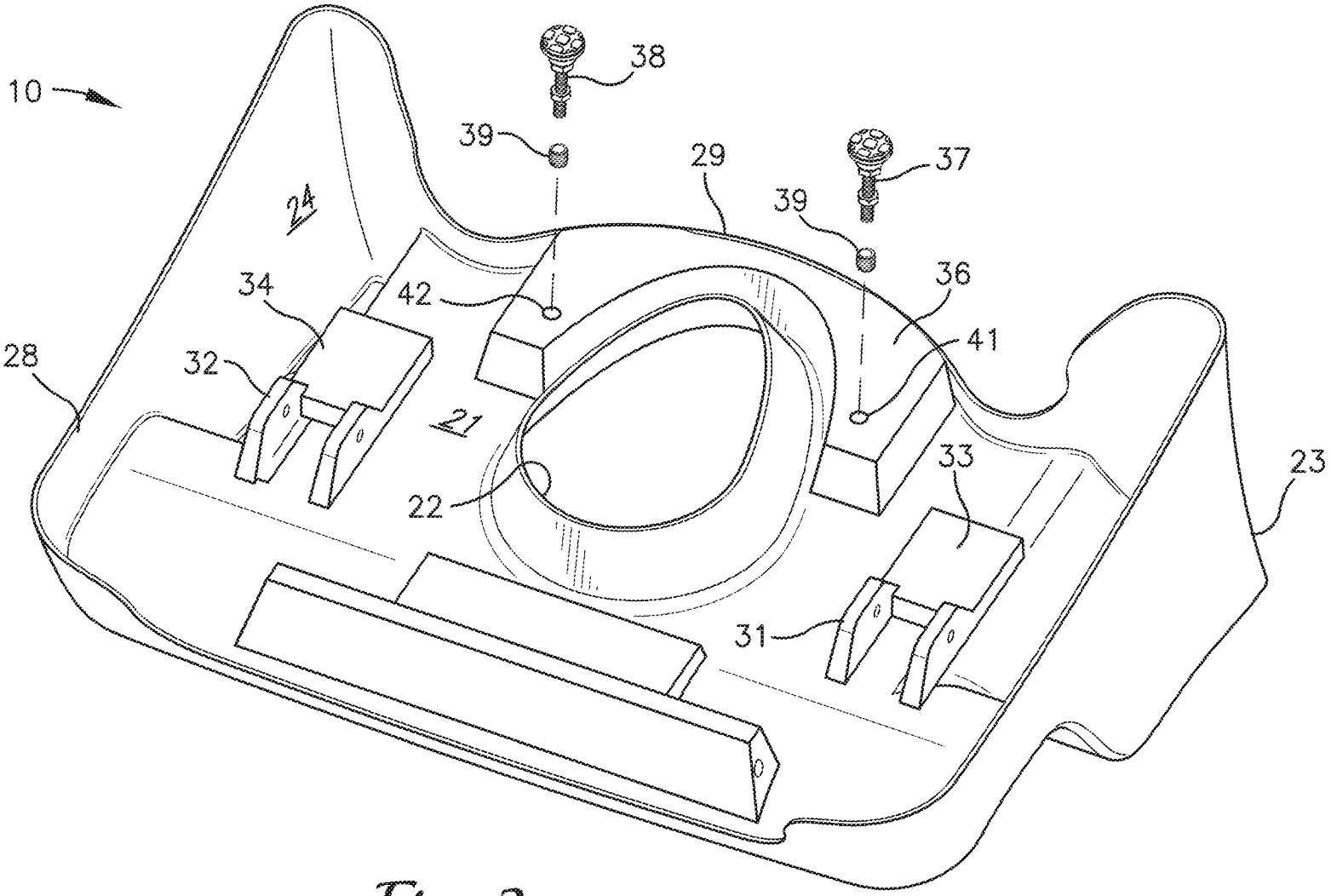
FIG. 3 is a perspective view of the lift seat from below.

FIG. 3 shows an underside of the lift seat 10. Left and right clevises 31 and 32 are formed in and project below the underside of the seat platform 21. Abutment features in the form of left and right stop pads 33 and 34 are also formed in and project below the underside of the seat platform 21 directly in front of the left and right clevises 31 and 32 respectively. The underside of the platform 21 is formed thicker under at least the forward section of the seating area 26 and partially around the oval opening 22. The thicker area may be referred to as a buttress 36. Left and right leveling feet 37 and 38 are threadably secured in threaded receivers 39 secured in left and right bores 41 and 42 formed in the buttress 36 on opposite sides of the opening 22. The bores 41 and 42 are spaced to position the left and right leveling feet 37 and 38 to engage the rim 7 of the toilet bowl 3 when the seat 10 is lowered relative to the bowl 3.

Figure 2:
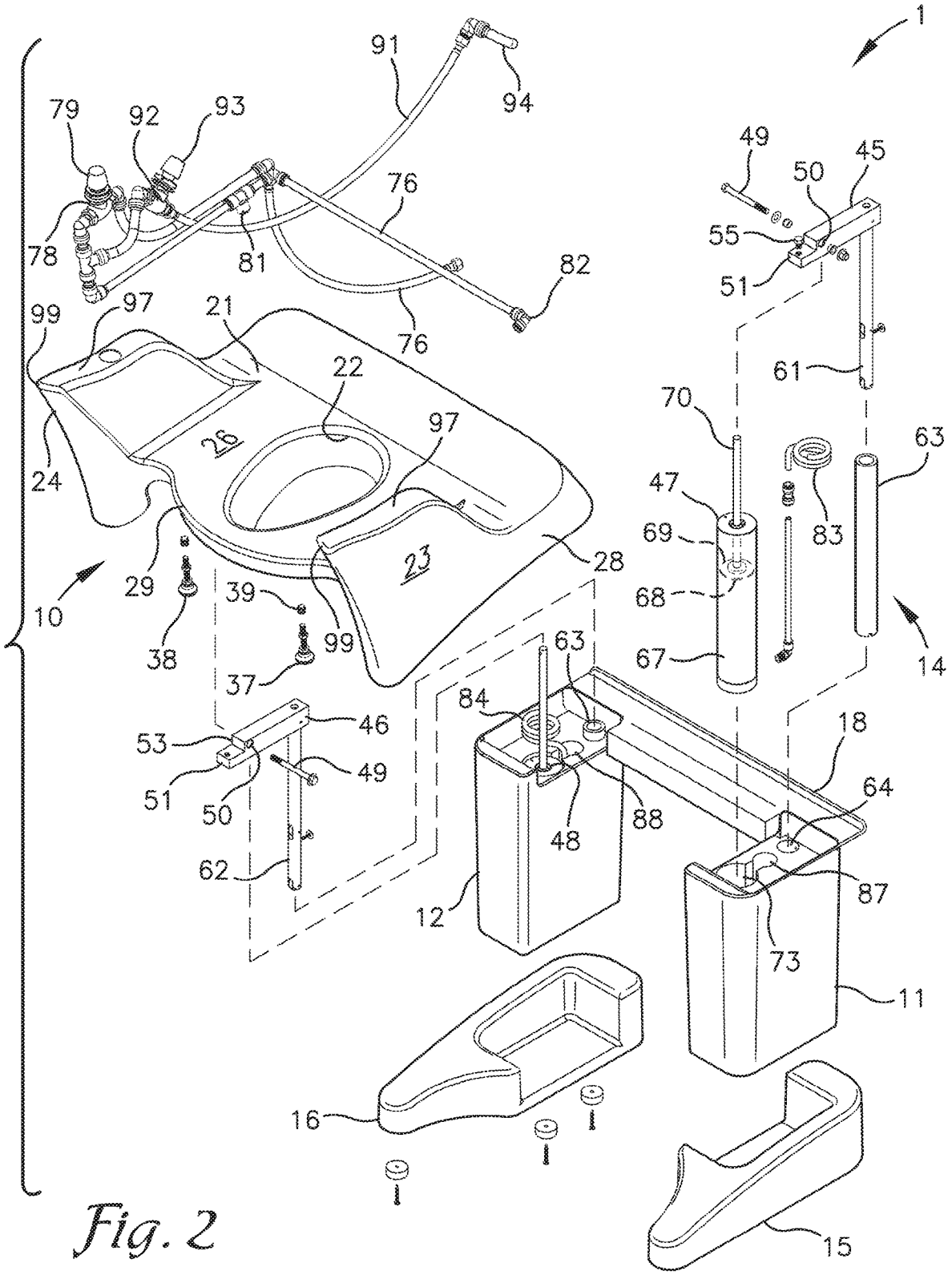
FIG. 2 is an exploded perspective view of the toilet lift seat assembly.

Referring again to FIG. 2, the hydraulic lift assembly 14 includes left and right lift blocks or pivot mounts 45 and 46 which are connected to and raised and lowered by left and right hydraulic actuators 47 and 48 respectively. The left and right clevises 31 and 32 on the underside of the lift seat 10 are pivotally connected to the left and right lift blocks 45 and 46 by a pivot pin 49 extending through aligned apertures in each clevis 31 and 32 and a pin receiving bore 50 extending through each lift block 45 and 46 transverse to a longitudinal axis of the lift blocks 45 and 46. The clevises 31 and 32 are positioned far enough rearward on the underside of the seat platform 21 such that a center of mass or gravity of the lift seat 10 with or without a person sitting on the seat 10 extends in front of the pivot axis of the seat 10 relative to the lift blocks 45 and 46. The bores 41 and 42 are formed in the buttress 36 to position the leveling feet 37 and 38 forward of the pivot axis of the seat 10 so that the leveling feet 37 and 38 engage the toilet bowl rim 7 when the left and right linear actuators 47 and 48 are retracted to a retracted position and the lift seat 10 is drawn down to a lowered position relative to the toilet bowl 3.

Figure 4:
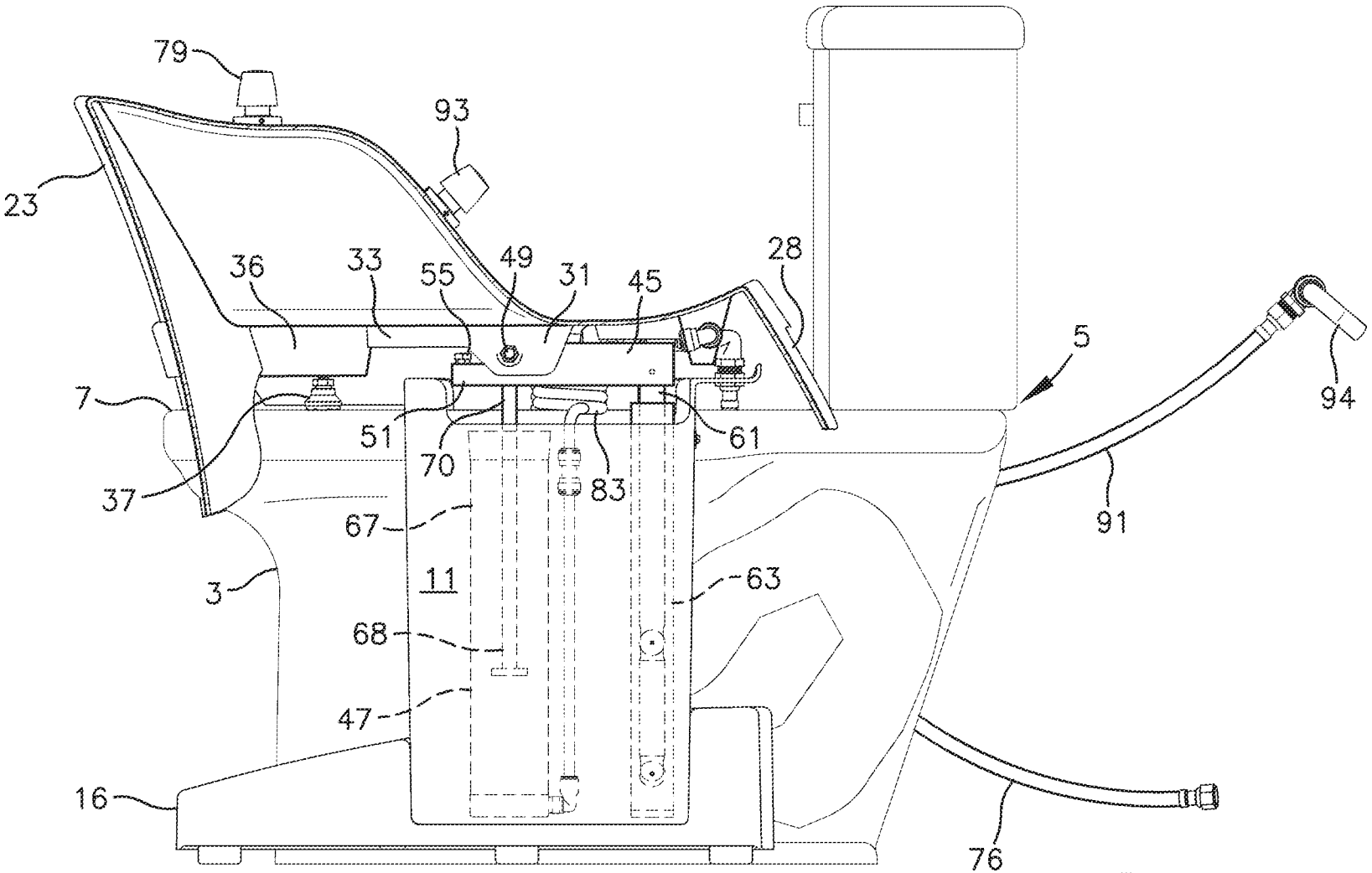
FIG. 4 is a cross-sectional view of the toilet lift seat assembly shown positioned over a toilet with the lift seat in a lowered position relative to the pedestals and extending generally horizontally relative to the rim of the bowl of the toilet.
Figure 5:
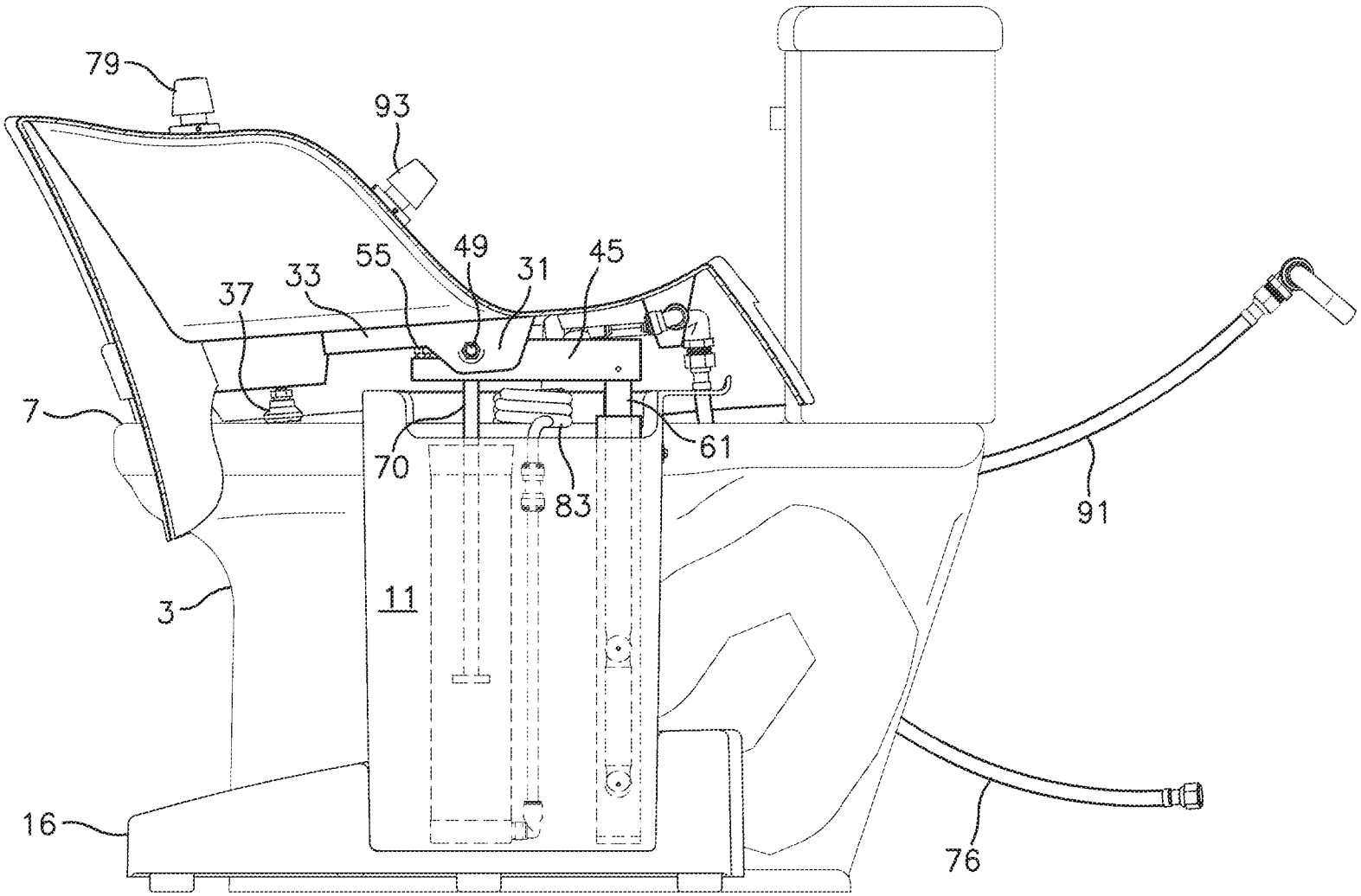
FIG. 5 is a view similar to FIG. 4 showing the lift seat partially raised by the hydraulic lift assembly with the lift seat tilted forward.
Figure 6:
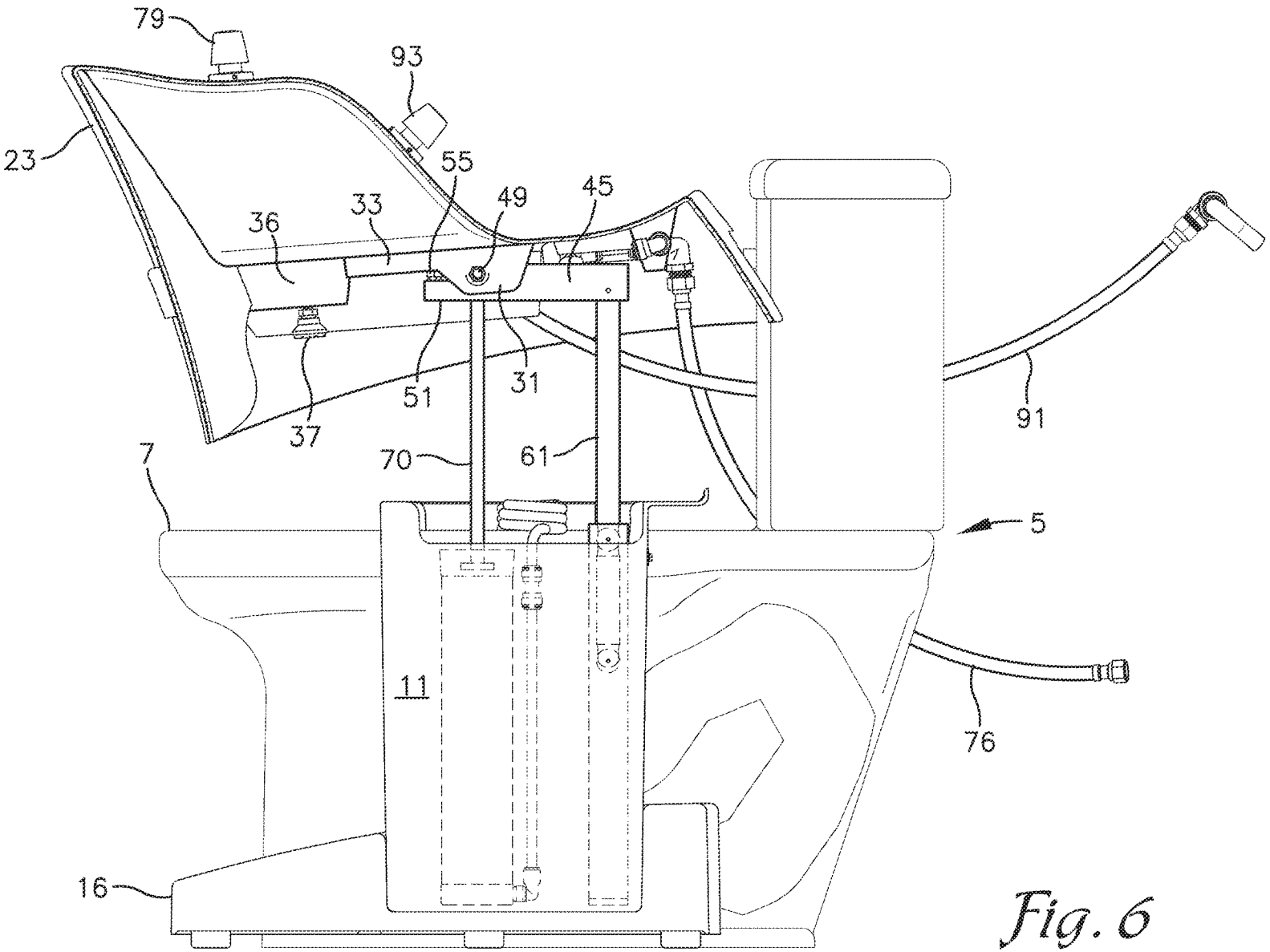
FIG. 6 is a view similar to FIG. 5 with the lift seat fully raised by the hydraulic lift assembly.

A stop flange 51 projects from a front end of each of the lift blocks 45 and 46 generally from a lower half thereof such that a recess 53 is formed above each of the stop flanges 51. A height adjustable stop feature or stop 55, which in the embodiment shown is formed by a bolt, is threadingly secured within a threaded bore formed in the stop flange 51 with the head of the bolt forming the stop 55 and extending above the flange 51 into the recess 53. The pivot pin receiving bore 50 formed in each lift block 45 and 46 extends in closely spaced relation behind the recess 53 formed therein. With the lift seat 10 pivotally connected to the lift blocks 45 and 46 by pivot pins 49, the left and right stop pads 33 and 34 on the underside of the lift seat 10 extend above the stops 55. As shown in FIG. 4, when the left and right actuators 47 and 48 are fully retracted, pads on the left and right leveling feet 37 and 38 engage the toilet bowl rim 7 to support the seating area 26 of the seat platform 21 generally horizontal or parallel to and in spaced relation above the toilet bowl rim 7. With the lift seat 10 lowered and the leveling feet 37 and 38 supporting the seat 10 above the rim 7, the left and right stop pads 33 and 34 are supported in spaced relation above the stops 55 on the stop flanges 51 of the left and right lift blocks 45 and 46. The leveling feet 37 and 38 can be threaded into and out of the bores 41 and 42 to adjust their length and ensure both feet 37 and 38 contact the rim 7 with the lift seat retracted to the lowered position and to adjust the size of the gap between the stops 55 and the left and right stop pads 33 and 34.

Figure 7:
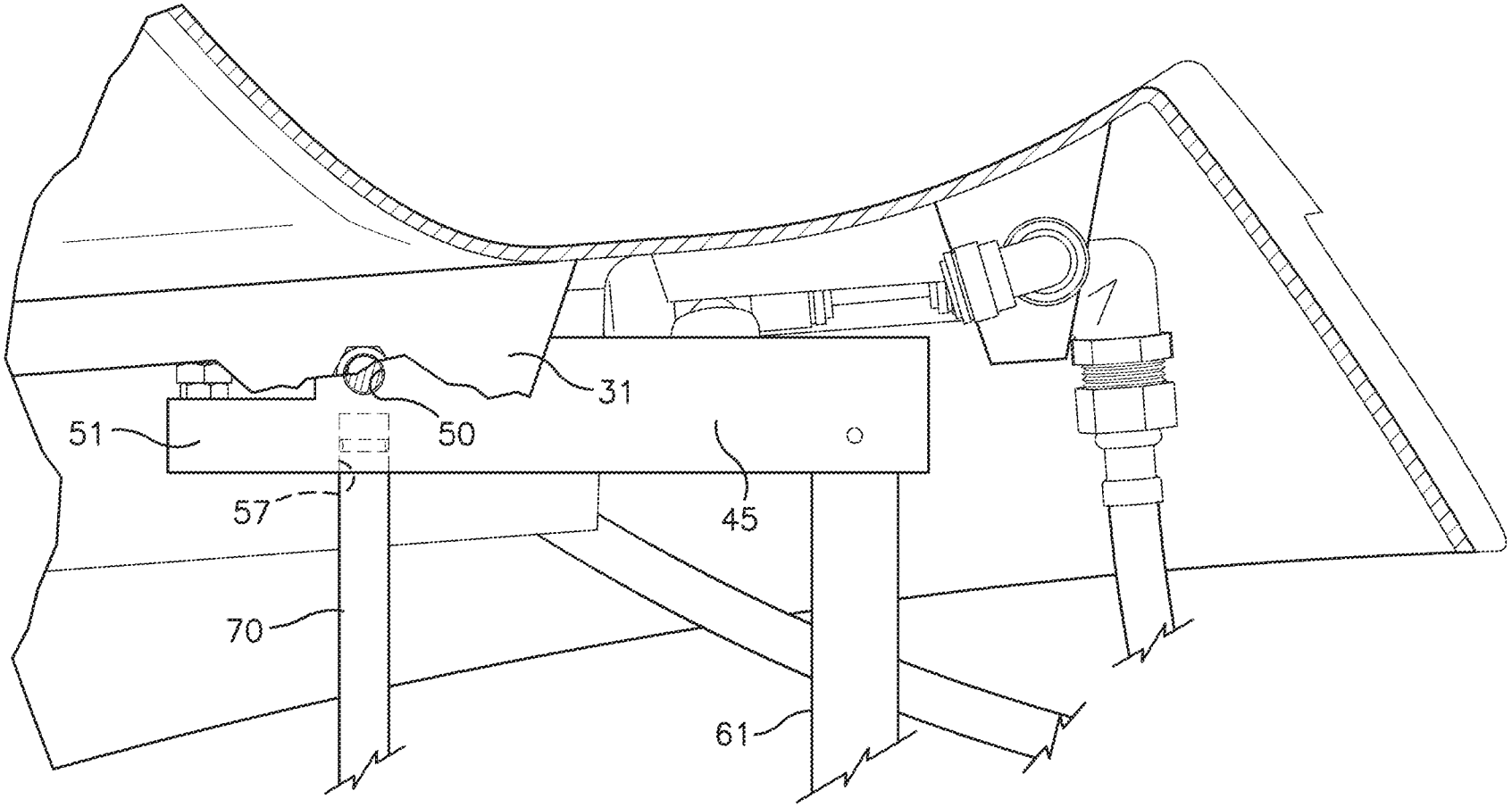
FIG. 7 is a greatly enlarged and fragmentary view similar to FIG. 6 with portions removed to show detail of the connection of a lift block relative to the lift seat and to a hydraulic actuator forming part of the hydraulic lift assembly.

Referring to FIG. 7, a piston or actuator receiving bore 57 is formed in the bottom of each lift block 45 and 46 in vertical alignment, transverse to and without intersecting the respective pivot pin receiving bore 50. Referring back to FIG. 2, left and right stabilizing rods 61 and 62 are connected to and project downward from a rear end of a respective left and right lift block 45 and 46. Each stabilizing rod 61 and 62 is received in a bearing sleeve 63 secured within a bore or hole 64 formed in a respective left and right pedestal 11 and 12. The left and right stabilizing rods 61 and 62 are longer than the vertical stroke of the left and right hydraulic actuators 47 and 48 so that a portion of each stabilizing rod 61 and 62 remains in the corresponding bearing sleeve 63 when the seat 10 is lifted to its peak by the actuators 47 and 48.

The left and right hydraulic actuators 47 and 48 each include a cylinder 67 and a piston 68. Each piston 68 includes a piston head 69 positioned within the cylinder 67 and a piston shaft or lifting rod 70 extending through an upper end of the cylinder 67. The piston 68 is slidably secured within the cylinder 67 and extends and retracts relative to the cylinder 67 in response to supplying or withdrawing a fluid, in this case water, from the cylinder 67. The cylinder 67 of each actuator 47 and 48 is received in a cylinder receiving hole or bore 73 formed in each pedestal 11 and 12 respectively such that the pedestals 11 and 12 support the associated linear actuator 47 and 48 respectively in a vertical orientation. The pedestals 11 and 12 may also be referred to as actuator supports. Although it is preferred that the actuators 47 and 48 extend truly vertical relative to the feet 15 and 16 of the assembly 1 and a floor on which the assembly 1 is supported, it is foreseen that the actuators 47 and 48 could be mounted to extend at a relatively small acute angle relative to vertical on the order of up to five or possibly up to ten degrees forward or rearward from true vertical.

The cylinder receiving bore 73 of each pedestal 11 and 12 is positioned in spaced relation in front of the bearing sleeve receiving bore 64. An upper end of the lifting rod 70 of the left and right actuators 47 and 48 is received in the piston receiving bore 57 of the associated left and right lift block 45 and 46. Simultaneous extension or retraction of the lifting rods 70 of left and right actuators 47 and 48 correspondingly raises and lowers the left and right lift blocks 45 and 46 respectively and the lift seat 10 connected thereto.

The left and right actuators are driven by water from the water supply line (not shown) for the toilet. A T-connection (not shown) is connected to the toilet water supply line and lift seat water supply line 76 is connected to the T-connection. The lift seat water supply line 76 extends into and is connected to the right arm support 24 of the seat 10 by a supply valve 78 having a supply valve actuator 79 extending through a hole in the right arm support 24 for access by a user. From the supply valve 79, the lift seat water supply line 76 extends back under the lift seat 10 below the right arm support 24 to a right actuator supply T-connector 81. The lift seat water supply line 76 is then routed across and below the back of the toilet seat platform 21 and then to a position under the left arm support 23 ending at a left actuator supply fitting 82. A first or left extendable supply line 83 is connected between and flow connects the supply fitting 82 to the base of the cylinder 67 of the left hydraulic actuator 47. A second or right extendable supply line 84 is connected between and flow connects the T-connector 81 and the base of the cylinder 67 of the right hydraulic actuator 48. Left and right access holes 87 and 88 are formed in upper surfaces of left and right pedestals 11 and 12 through which the left and right extendable supply lines 83 and 84 can extend to connect to the left and right hydraulic actuators 47 and 48. At least a section of each of the left and right extendable supply lines 83 and 84 may be formed form a coiled length of flexible tubing to allow the supply lines 83 and 84 to effectively extend in length when the seat to which the lift seat water supply line 76 is connected is raised relative to the pedestals 11 and 12 and to contract when the lift seat 10 is lowered relative to the pedestals 11 and 12.

A drain line 91 branches off the lift seat water supply line 76 downstream or past the supply valve 78. A drain valve 92 is mounted on the drain line 91 and is connected to the right arm support 24 with a drain valve actuator 93 extending through a second hole formed in second arm support 24. An outlet end 94 of the drain line 91 is supported from the underside of the seat platform 21 to open toward and direct water into the toilet bowl 3 over which the lift seat 10 is positioned.

Supply valve 78 and drain valve are both normally, spring biased closed. With a user seated on lift seat 10 depression of the supply valve actuator 79 opens the supply valve 78 so that water from the lift seat water supply line 76 flows to the base of the cylinders 67 of the left and right hydraulic actuators 47 and 48 driving the actuator pistons 68 and associated lifting rods 70 in the cylinders 67 upward and causing the left and right lift blocks 45 and 46 to rise. Because the center of gravity of the lift seat 10 (either occupied or unoccupied) is in front of the pivotal connection between the lift seat 10 and the lift blocks 45 and 46, the lift seat 10 initially pivots forward relative to the rising lift blocks 45 and 46 until the top of the stops 55 on the lift block stop flanges 51 engage the underside of the left and right stop pads 33 and 34 on the underside of the lift seat 10. In a preferred embodiment, the lift seat 10 pivots at an angle of approximately five to ten degrees forward until the stops 55 engage the stop pads 33 and 34. The degree to which the lift seat pivots relative to the lift blocks 45 and 46 until the stop pads 33 and 34 engage the stops 55 can be adjusted by adjusting the height of the top of the stops 55 relative to the stop flanges 51 on the lift blocks 45 and 46 by threading the bolt forming each stop up or down relative to the stop flange 51 in which it is secured.

Once the left and right stop pads 33 and 34 on the lift seat 10 engage the stops 55 on the left and right lift blocks 45 and 46, the lift seat 10 stops pivoting relative to the lift blocks 45 and 46 and the lift seat 10 then the entire lift seat 10 rises vertically relative to the pedestals 11 and 12 with the lift seat pivoted slightly forward. Once left and right actuators 47 and 48 are fully extended, the supply valve 78 closes holding the lift chair 10 in the raised position. The initial forward pivoting of the lift seat 10 is intended to move the user's body forward and more over his or her feet resting on the floor and to angle the front edge 29 of the seat downward to make it easier for the user to move off the lift seat 10 once the lift seat assembly 1 lifts the user closer to a standing position. The movement of the lift chair 10 pivoting slightly forward and then moving straight up more closely tracks the movement of a person standing from a seated position on a toilet seat without the aid of a lifting device.

With the lift seat 10 in the raised position, the lift seat assembly 1 is ready for the next user. The user, facing away from the lift seat 10 and with their hands on the left and right arm supports 23 and 24 lowers their rear onto the lift seat 10 which is angled at an acute angle forward. The user then depresses the drain valve actuator 93 which opens drain valve 92. The weight of the user and the lift seat 10 acting on the left and right lifting rods 70 and on the actuator pistons 68 of the left and right hydraulic actuators 47 and 48 forces water out of the cylinders 67 through the drain line 91 and into the toilet bowl 3 causing the lift seat 10 to slowly lower vertically while still angled slightly forward. When the lift seat 10 is lowered to the point the left and right leveling feet 37 and 38 engage the rim 7 of the toilet bowl 3, continued lowering of the actuator pistons 68 causes the rear of the lift seat 10 to pivot downward relative to the front edge 29 until the actuator pistons 68 are fully retracted with the lift seat 10 extending generally horizontally with the user seated thereon. Downward pivoting of the rear of the lift seat 10 relative to the front edge 29 and relative to the lift blocks 45 and 46 moves the stop pads 33 and 34 on the underside of seat 10 off of the stops 55 on the stop flanges 51 of lift blocks 45 and 46 creating the gap to allow forward pivoting of the seat 10 relative to the lift blocks 45 and 46 when the lift seat is subsequently raised.

The left and right support arms 23 and 24 are constructed so that an upper surface 97 of each is positioned generally level with a user's elbow when seated on the seat 10 to facilitate placement of the user's hands on the upper surface 97 of the support arms 23 and 24 when lowering or lifting themselves off of the lift seat 10. When the seat 10 is retracted to the lowered position, the upper surface 97 of each support arm 23 and 24 preferably slopes upward from rear to front to a forward edge 99 that extends forward of the front edge 29 of the seat 10. The slope of the upper surface 97 of the support arms 23 and 24 is selected to be slightly greater than the angle at which the seat 10 tilts forward when lifted so that when the lift seat 10 is lifted, the upper surface 97 of each support arms 23 and 24 extends at least at a slight angle downward from rear to front to assist the user in pushing off of the upper surface 97 of each support arm 23 and 24 to lift themselves off the seat 10.

It is to be understood that while certain forms of the present invention have been illustrated and described herein, it is not to be limited to the specific forms or arrangement of parts described and shown.

What is claimed is:

1. A toilet lift seat for a toilet having a toilet bowl with a toilet bowl rim, the toilet lift seat comprising:

a toilet seat having a toilet seat opening extending therethrough;

left and right actuators supported in left and right actuator supports; said left and right actuators are supported by the left and right actuator supports to be oriented vertically and to extend in spaced relation on opposite sides of the toilet bowl of the toilet with which the toilet seat is used;

an underside of the toilet seat pivotally connected on opposite sides of the toilet seat opening relative to upper ends of the left and right actuators such that a center of gravity of the toilet seat extends forward of a pivot axis of the toilet seat relative to the left and right actuators;

left and right stops connected to the left and right actuators proximate the upper ends thereof;

a front portion of the toilet seat, extending forward of the pivot axis, is supported on the toilet bowl rim when the left and right actuators are retracted to a retracted position whereby the toilet seat is drawn down to a lowered position relative to the toilet bowl;

wherein upon vertical extension of the left and right actuators from the retracted position, the front portion of the toilet seat pivots downward relative to the upper ends of the left and right actuators and remains supported on the toilet bowl rim until left and right abutment features on the underside of the toilet seat abut against the left and right stops respectively preventing further forward pivoting of the toilet seat relative to the left and right actuators, and further vertical extension of the left and right actuators lifts the toilet seat, including the downwardly pivoted front portion of the toilet seat, vertically relative to the toilet bowl rim.

2. The toilet lift seat as in claim 1 wherein an upper surface of each of the left and right stops is vertically adjustable relative to the upper ends of left and right actuators respectively.

3. The toilet lift seat as in claim 1 further comprising at least one leveling foot threadably connected to the underside of the toilet seat forward of the pivot axis of the toilet seat and projecting downward relative thereto and positioned to engage the toilet bowl rim when the left and right linear actuators are retracted to a retracted position and the toilet seat is drawn down to a lowered position relative to the toilet bowl.

4. The toilet lift seat as in claim 1 wherein each of the left and right actuators includes a piston head and a lifting rod slidingly secured within a cylinder, a lift seat water supply line is flow connectable between a water supply line for the toilet and the cylinder of each of the left and right actuators below the piston head, a supply valve is connected to the lift seat water supply line, the supply valve is normally spring biased closed to prevent water from flowing to the left and right actuators and actuatable to supply water to the cylinder of the left and right actuators below the piston head to lift the lifting rod of each of the left and right actuators, a drain line is connected to the lift seat water supply line by a drain valve positioned between the supply valve and the left and right actuators, an outlet end of the drain line is positionable to direct water into the toilet bowl, and the drain valve is normally spring biased closed and actuatable to allow water to flow from the left and right actuators through and out of the drain line into the toilet bowl.

5. The toilet lift seat as in claim 1 wherein the left and right stops are formed on left and right lift blocks respectively connected at upper ends to the left and right actuators respectively and the toilet lift seat further comprises left and right stabilizing rods connected to and projecting downward from the left and right lift blocks respectively on a side of the left and right actuators opposite the left and right stops, and wherein lower ends of the left and right stabilizing rods extend into left and right receivers extending into the left and right actuator supports respectively.

6. A toilet lift seat for a toilet having a toilet bowl with a toilet bowl rim, the toilet lift seat comprising:

a toilet seat having a toilet seat opening extending therethrough;

left and right linear actuators supported in left and right actuator supports; said left and right linear actuators are supported by the left and right actuator supports to be oriented vertically and to extend in spaced relation on opposite sides of the toilet bowl of the toilet with which the toilet seat is used;

left and right pivot mounts supported on upper ends of the left and right linear actuators;

left and right stop features are associated with and extend forward of the left and right pivot mounts respectively;

an underside of the toilet seat pivotally connected on opposite sides of the toilet seat opening to the left and right pivot mounts such that a center of gravity of the toilet seat extends forward of a pivot axis of the toilet seat relative to the left and right pivot mounts;

a front portion of the toilet seat, extending forward of the pivot axis, is supported on the toilet bowl rim when and a gap extends between the stop features on the left and right pivot mounts and left and right abutment features respectively on the underside of the toilet seat;

wherein upon vertical extension of the left and right linear actuators from the retracted position, the front portion of the toilet seat pivots downward relative to the left and right pivot mounts supported on the upper ends of the left and right linear actuators and remains supported on the toilet bowl rim until the left and right abutment features on the underside of the toilet seat abut against the left and right stops respectively preventing further forward pivoting of the toilet seat relative to the left and right linear actuators, and further vertical extension of the left and right linear actuators lifts the toilet seat, including the downwardly pivoted front portion of the toilet seat, vertically relative to the toilet bowl rim.

7. The toilet lift seat as in claim 6 wherein an upper surface of each of the left and right stops is vertically adjustable relative to the left and right pivot mounts respectively.

8. The toilet lift seat as in claim 6 further comprising at least one leveling foot threadably connected to the underside of the toilet seat forward of the pivot axis of the toilet seat and projecting downward relative thereto and positioned to engage the toilet bowl rim when the left and right linear actuators are retracted to a retracted position and the toilet seat is drawn down to a lowered position relative to the toilet bowl.

9. The toilet lift seat as in claim 6 wherein each of the left and right actuators includes a piston head and a lifting rod slidingly secured within a cylinder, a lift seat water supply line is flow connectable between a water supply line for the toilet and the cylinder of each of the left and right actuators below the piston head, a supply valve is connected to the lift seat water supply line, the supply valve is normally spring biased closed to prevent water from flowing to the left and right actuators and actuatable to supply water to the cylinder of the left and right actuators below the piston head to lift the lifting rod of each of the left and right actuators, a drain line is connected to the lift seat water supply line by a drain valve positioned between the supply valve and the left and right actuators, an outlet end of the drain line is positionable to direct water into the toilet bowl, and the drain valve is normally spring biased closed and actuatable to allow water to flow from the left and right actuators through and out of the drain line into the toilet bowl.

10. The toilet lift seat as in claim 6 further comprising left and right stabilizing rods connected to and projecting downward from the left and right pivot mounts respectively on a side of the left and right actuators opposite the left and right stop features, and wherein lower ends of the left and right stabilizing rods extend into left and right receivers extending into the left and right actuator supports respectively.

* * * * *